United States Patent [19]

Deb

[11] Patent Number: 4,864,262

[45] Date of Patent: Sep. 5, 1989

[54] UNDERVOLTAGE TRIP DEVICE

[75] Inventor: Anup K. Deb, Irwin, Pa.

[73] Assignee: Westinghouse Electric Corp., Pittsburgh, Pa.

[21] Appl. No.: 231,038

[22] Filed: Aug. 12, 1988

[51] Int. Cl.[4] ..... H01H 83/06; H01H 73/06

[52] U.S. Cl. ..... 335/20; 335/175

[58] Field of Search ..... 335/20, 14, 175

[56] References Cited

U.S. PATENT DOCUMENTS

| | | | |
|---|---|---|---|
| 1,144,308 | 6/1915 | Jacobs . | |
| 1,175,323 | 3/1916 | Wikander . | |
| 1,642,288 | 9/1922 | Ainsworth . | |
| 2,280,899 | 4/1942 | Dyer et al. . | |
| 3,293,577 | 9/1965 | Kiesel et al. . | |
| 3,453,568 | 12/1967 | Murphy et al. . | |
| 3,530,414 | 2/1969 | Wagner . | |
| 3,533,024 | 3/1969 | Heintz . | |
| 3,559,125 | 1/1969 | Ellis, Jr. . | |
| 3,783,423 | 1/1974 | Mater et al. . | |
| 3,914,720 | 10/1975 | Drubig . | |
| 4,048,599 | 9/1977 | Groth . | |
| 4,068,280 | 1/1978 | Basile et al. . | |
| 4,206,430 | 6/1980 | Rusch et al. . | |
| 4,345,226 | 8/1982 | Debaigt . | |
| 4,489,295 | 12/1984 | Altenhof, Jr. et al. . | |
| 4,608,546 | 8/1986 | Westermeyer . | |
| 4,620,171 | 10/1986 | Bagalini | 335/20 |

FOREIGN PATENT DOCUMENTS

| | | | |
|---|---|---|---|
| 34143 | 2/1922 | Norway | 335/20 |

*Primary Examiner*—H. Broome

[57] ABSTRACT

A coil produces a magnetic field in response to an applied voltage which suspends a core in a predetermined position above a trip arm. The trip arm is pivotally mounted between a normally reset position and a tripped position. In the absence of an undervoltage condition, the magnetic field produced by the coil exerts a sufficient force to suspend the core against gravity above a first free end of the trip arm. A second free end of the trip arm is adapted to trip a circuit breaker when the trip arm is rotated from the reset position to the tripped position. When an undervoltage condition occurs, the core drops onto the first free end of the trip arm and the second free end pivots to trip the breaker.

The coil is normally energized for maintaining the core suspended against gravity and heat is produced in the coil as a result of current flow therein. A cooling convection air path facilitates heat dissipation in the coil.

25 Claims, 5 Drawing Sheets

UNDERVOLTAGE TRIP DEVICE

BACKGROUND OF THE INVENTION

The invention is directed generally to safety equipment which electrically senses an unsafe condition and produces an appropriate mechanical response. In particular, the invention is directed to an electromechanical undervoltage trip device which senses an undervoltage condition and causes the circuit breaker to trip.

Reliability is an essential characteristic of safety equipment. A trip device is a type of safety equipment which is useful to activate or trip a circuit breaker under appropriate conditions. Circuit breakers (hereinafter sometimes referred to as a breaker or breakers) are designed to open electrical circuits when activated. In some applications, the opening of a breaker initiates a chain of events which brings connected equipment to a safe state or stable condition. The sensitivity or the amount of tripping force necessary to trip a particular breaker bears directly on the characteristics of the particular trip devices used.

Some circuit breakers are tripped by the displacement of a trip bar. Trip devices capable of tripping such breakers, in addition to providing sufficient tripping force, must provide the necessary displacement to the trip bar to cause the breaker to trip. In some breakers, for example, motion of the trip bar releases a latch or other mechanism which otherwise holds the breaker contacts engaged. Springs or other force producing means often restrain or secure the latch against release. The force needed to release the latch depends in part on the force needed to move the latch against the bias of the spring. Frictional and inertial forces also affect the force needed to release the latch. Large safety breakers often require significant tripping force and significant trip bar displacement to cause a trip. Thus, in certain applications, forceful and significant motion must be provided in order to effect a breaker trip.

The term undervoltage as used herein encompasses a variety of electrical conditions. For example, in addition to voltage, which is the parameter specifically discussed herein, other electrical parameters (e.g., current, power, and so on) may be monitored by the apparatus of the present invention. It is intended that the monitoring of such other parameters falls within the scope of the invention.

Undervoltage trip devices operate to produce a response when a monitored voltage drops below a given level that is indicative of an unsafe condition. Such response may include moving a lever or trip arm with a force and displacement sufficient to trip a breaker of a given configuration. Present undervoltage trip devices generally consist of complicated multi-stage mechanisms, including at least one sensor mechanism alone and at least one actuation mechanism. Multi-stage mechanisms are often required because the response of one sensor, or one actuation mechanism alone, creates insufficient force or displacement to directly trip a circuit breaker.

In some devices, the sensor mechanism consists of an electromagnetic coil, which, when energized, produces a force sufficient to restrain a mass against an opposing force, such as the bias of a spring or gravity. When the voltage applied to the coil falls below a predetermined value, the spring bias or gravity overcomes the opposing force produced by the Coil and thereby allows the mass to move.

The actuating mechanism in such a device often includes a combination of friction latches, levers and springs which cooperate to sense the motion of the mass and to produce a mechanical response having a force and displacement sufficient to trip the circuit breaker. The actuation mechanism itself may consist of multiple stages designed to produce force and displacement amplification, with each state producing a more forceful and more perceptible displacement output than the preceding stage.

Prior undervoltage trip devices are susceptible to failure in a number of failure modes. In one mode, sometimes referred to as the frictional failure mode, the frictional forces associated with sensing mechanisms increase over time to a point where the force required to move the mass becomes too great, or the force produced by the moving mass becomes insufficient to activate the actuation mechanisms. Likewise, actuation mechanisms may experience increased frictional forces over time, whereby they become disabled or inoperative. In another failure mode, sometimes called the output failure mode, the force produced by the trip device decreases to a point where the device can no longer trip the breaker, even if all the various mechanisms operate.

Multi-stage devices are complex, often requiring many precision parts which are difficult to assemble. In order to reduce the possibility of failure, such devices require strict manufacturing tolerances for the many parts, extensive inspection of parts and sub-assemblies, rigorous testing, and frequent and complex maintenance schedules (e.g., lubrication) after installation. The aforementioned characteristics of multi-stage devices and their particular manufacturing requirements result in a high cost of manufacture and significant maintenance costs to ensure reliability.

SUMMARY OF THE INVENTION

The invention relates to a safety device which senses an undervoltage condition and produces a mechanical response for tripping a circuit breaker. The device is particularly adapted to reliably overcome resistive forces restraining a circuit breaker against the trip without the need for staged amplification of the mechanical response.

Electromagnetic means including a coil and an associated core having a significant mass is mounted in a frame. The coil produces a magnetic field in response to an applied voltage which suspends the core in a predetermined elevated position within the coil. A trip arm has two free ends and is pivotally mounted on the frame about a fulcrum. The trip arm is pivotally movable to produce the mechanical response between a normally reset position and a tripped position. In the absence of an undervoltage condition, the magnetic field produced by the coil exerts a sufficient force on the core to suspend it against gravity above the first free end of the trip arm. The second free end of the trip arm is adapted to trip a circuit breaker when the trip arm is pivoted from the reset position to the tripped position. When an undervoltage condition occurs, the magnetic field of the coil collapses and force of gravity pulls the core down onto the first free end of the trip arm. The mass of the core and the position of the fulcrum relative to the first and second free ends of the trip arm are chosen so that the force of the core on the first free end of the trip arm pivots the trip arm about its fulcrum with sufficient force and displacement at the second free end of the trip arm for tripping the breaker. The core and first free end of the trip arm are responsive to the magnetic field. In the absence of an undervoltage condition, the core becomes suspended and the trip arm pivots to the reset position.

The coil is normally energized for maintaining the core suspended against gravity, and heat is produced in the coil as a result of current flow therein. Means including a cooling convection path facilitate heat dissipation in the coil.

DESCRIPTION OF THE INVENTION

Figure 1:
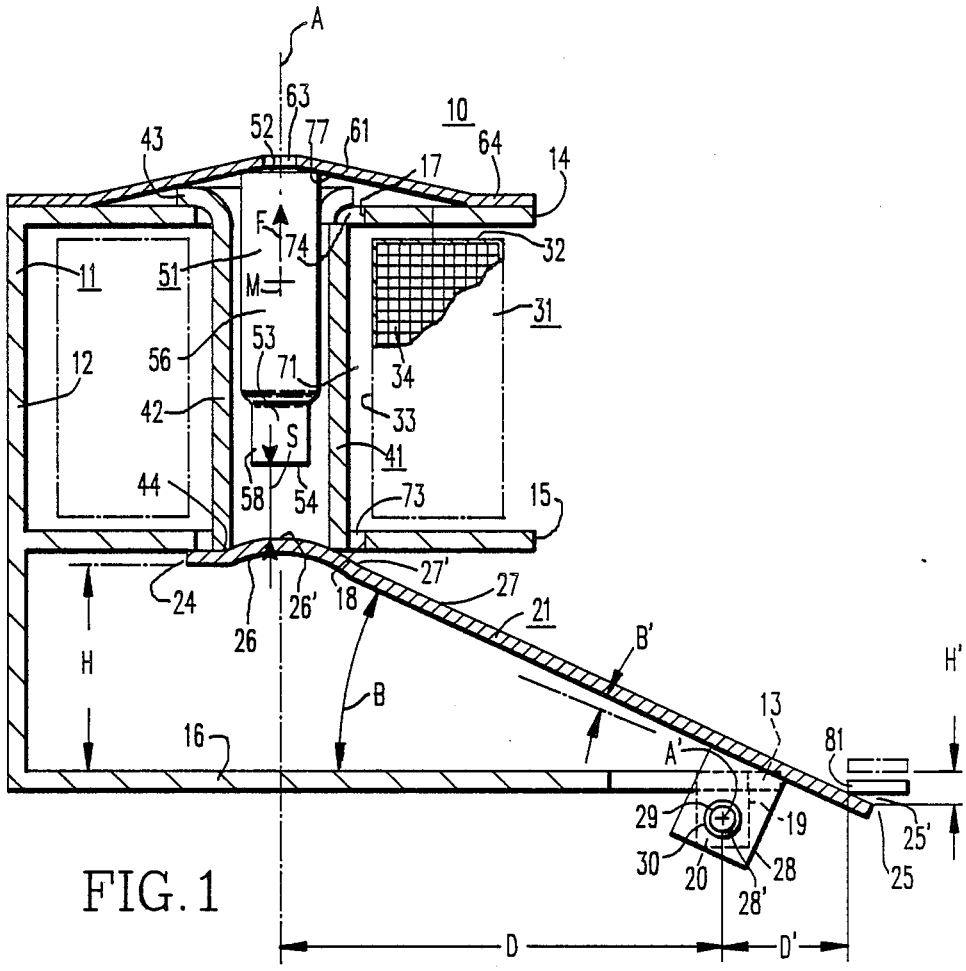
FIG. 1 is a schematic side section elevation of an undervoltage trip device in accordance with the present invention, with the components shown in a reset position.
Figure 2:
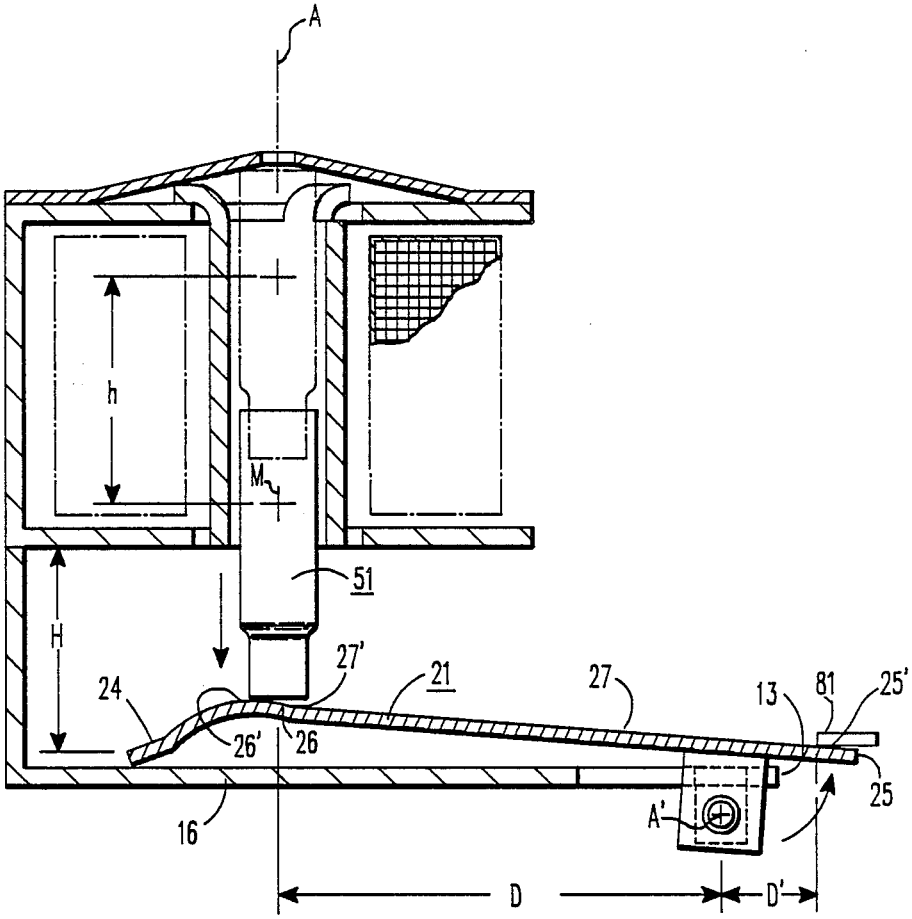
FIG. 2 is a schematic side section elevation of the undervoltage trip device of the present invention with the components in a tripped position.

FIG. 1 is a schematic side section elevation of an undervoltage trip device 10 made in accordance with the teachings of the present invention. The undervoltage trip device 10 (sometimes hereinafter referred to as trip device 10) is shown in a reset condition. The trip device 10 is adapted to trip a circuit breaker (not shown) and includes a frame 11, a trip arm 21 mounted to the frame, a coil assembly 31 supported in the frame, a sleeve 41 located in the coil 31, a movable core 51 located within the sleeve, and an apertured cover 61 secured to the frame 11 over the coil 31. A trip bar 81 of the circuit breaker (not shown) is illustrated to place the trip device 10 in an operational context. The circuit breaker and trip bar 8; form no part of the present invention. FIG. 2 shows a side section elevational view of the trip device 10 in a tripped condition.

Figure 3:
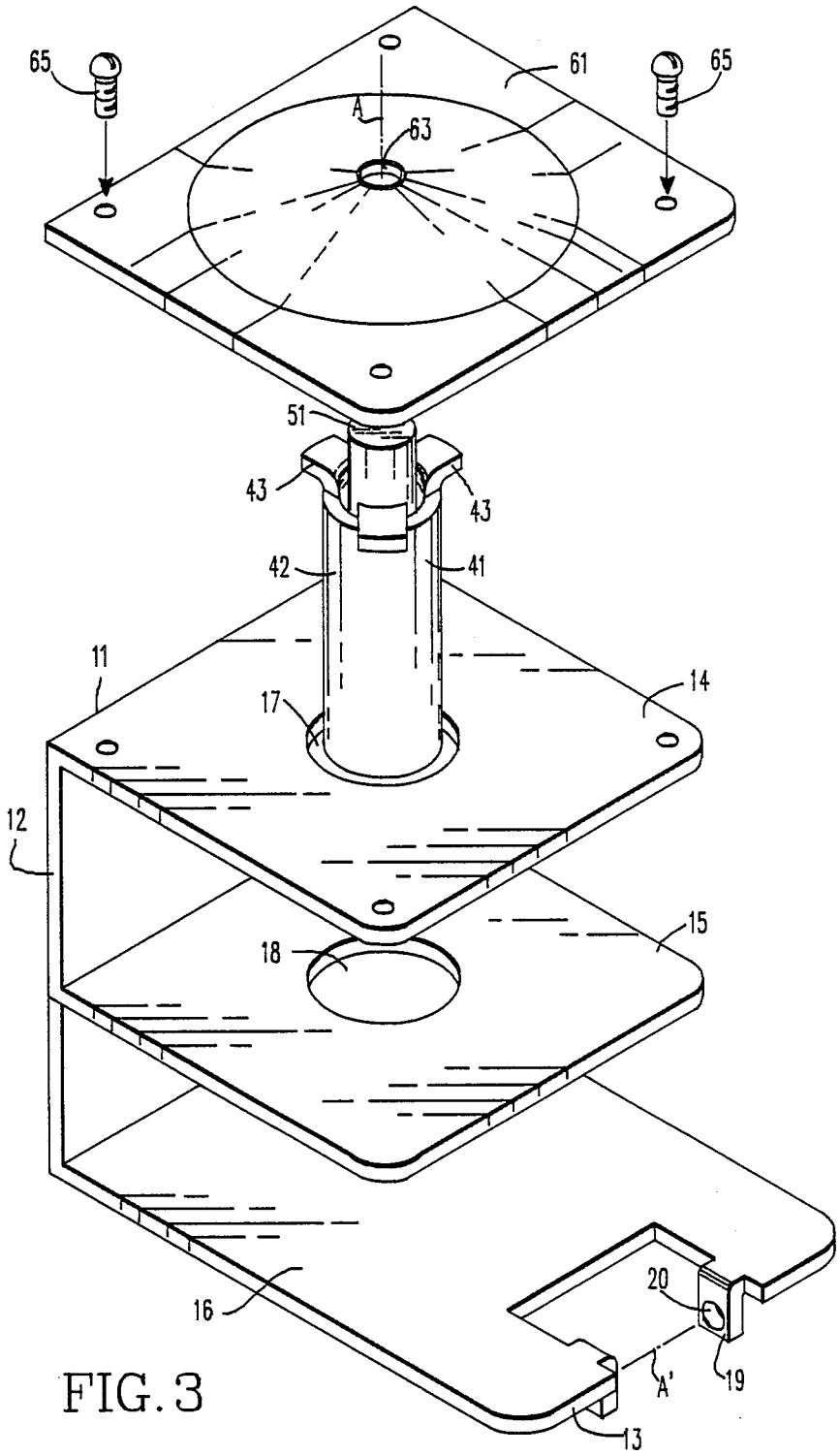
FIG. 3 is a partial exploded perspective view of selected components of the undervoltage trip device of the present invention, including the frame, sleeve and core.

The frame 11 is best seen in FIG. 3, and includes a vertical support 12, an attached upper shelf 14 of a given length, an attached lower shelf 15 of similar length and an attached base 16. The upper shelf 14 has a circular aperture 17 located as shown and centered on an axis A. The lower shelf 15 is parallel to the upper shelf 14 and has a circular aperture 18 of the same size as the aperture 17 and likewise centered on axis A. The base 16 is longer than the lower shelf 15 and has a free end 13. Apertured tabs 19 are located near the free end 13 of the base 16 and depend therefrom in confronting relationship as shown. The tabs 19 have apertures 20 aligned along axis A'. The axes A and A' are separated by a distance D. (FIGS. 1 and 2.)

Figure 4:
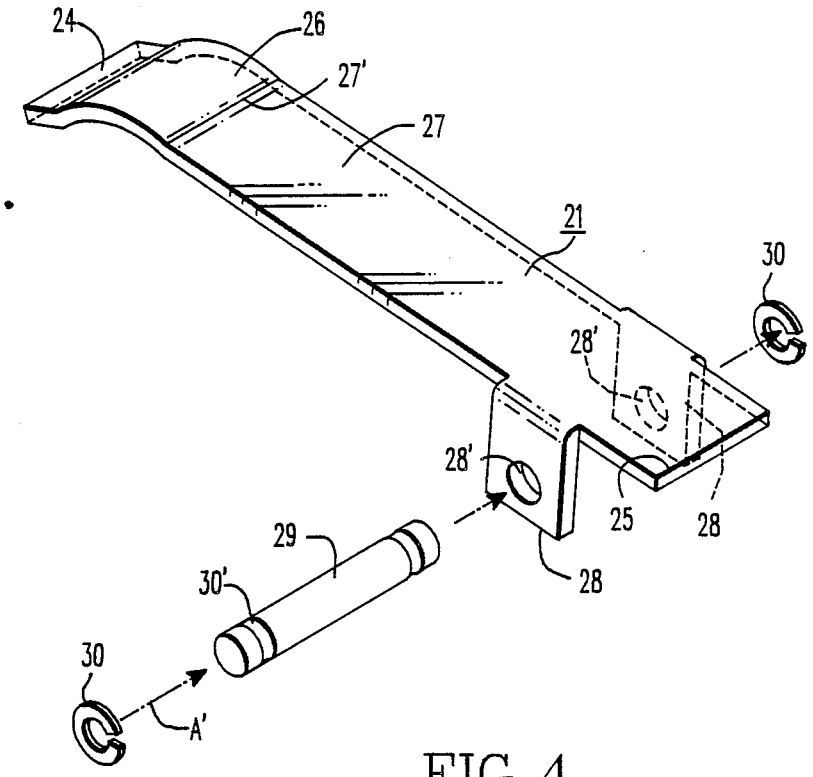
FIG. 4 is an exploded perspective view of the trip arm and pivot pin.

The trip arm 21, shown in exploded perspective in FIG. 4, is pivotably mounted to the base 16 of the frame 11 as shown in FIGS. 1 and 2. The trip arm 21 may be formed in one piece and has a first free end 24, a curved section 26, a straight section 27, a second free end 25 and depending and confronting apertured mounting tabs 28 having axially aligned apertures 28, As shown assembled in FIG. 1, for example, the apertures 20 in the tabs 19 on base 16 are aligned with the apertures 28' in the tabs 28 on the trip arm 21. A pivot pin 29, acting as a fulcrum for the trip arm, is located in the apertures 20 and 28,. The pivot pin rotatably secures the trip arm 21 to the frame 11 along the axis A'. The pivot pin 29 has outboard annular slots 30'. Retaining rings 30 located in slots 30' secure the pivot pin 29 in place in a manner known in the art. As can be seen by comparing FIGS. 1 and 2, the trip arm 21 is pivotable about the pivot pin 29 through an angle B, between the reset position shown in FIG. 1 and the tripped position shown in FIG. 2. In the embodiment shown in FIGS. 1–5 the trip arm 21 is a ferro-magnetic material which is normally held in the reset position (FIG. 1) by the magnetic field of the coil 31 in the absence of an undervoltage condition.

As seen in FIG. 1, the curved section 26 and the straight section 27 meet at bend line 27'. The curved section 26 is positioned below the core 51 and engages the lower end 44 of the sleeve 41 as shown. When the trip arm 21 is reset as shown in FIG. 1, the curved section 26 extends into the aperture 18 from below. The particular curved configuration of the interconnected free end 24, the curved section 26 and the interconnected straight section 27 of the trip arm 21 allows the free end 24 to lie flat against the lower shelf 15.

The second free end 25 of the trip arm 21 engages the trip bar 81 of the circuit breaker at a point 25' centered at distance D' from the axis A'. The ratio of the distances D/D' is a measure of the mechanical advantage of the trip arm of the present invention.

As can be seen in FIGS. 1 and 2, the first free end 24 of the trip arm 21 moves a tripping distance H through an angle B between the reset position shown in FIG. 1 and the tripped position shown in FIG. 2. The second free end 25 of the trip arm 21 moves a trip displacement distance H' also through angle B between the reset and tripped positions. The ratio of the distances H/H' is a measure of the displacement advantage achieved by the apparatus of the present invention. The displacement distance H' is sufficient to move the trip bar 81 to a tripped position. For example, reference is directed to the phantom views of trip bar 81 in FIGS. 1 and 2.

Tripping distance H and the displacement distance H' are enhanced by the particular configuration of the curved section 26 and the interconnected straight section 27 as well as the location of the pivot pin 29 acting as the fulcrum for the trip arm 21. The transition between the curved section 26 and the straight section 27 at the bend line 27' is relatively smooth and almost establishes a tangent relationship between the aforementioned section. The resulting shape of the trip arm 21 is such that it is nonplanar. This is best illustrated in FIG. 1 wherein a dotted line extends between the free ends and forms an angle B' with the lower surface of the straight section 27. Thus, the angle B is greater by the amount B' than if the trip arm 21 were planar.

The additional rotational angle (B'), provided by the curved section 26 as described above, is utilized to enhance the output force at the free end 25 as an incremental increase in the distance through which the core falls, thereby providing more momentum to the trip arm 21 which translates into greater force exerted by the trip arm 21 against the trip bar 81. The increased displacement distance H' assures more reliable and positive actuation of the trip bar 81.

As best seen in FIG. 1, the coil 31 comprises a spool 32, a winding of electrically insulated conductor 34 continuously wound about the spool 32. The spool 32 has a hollow cylindrical central shaftway 33 of a configuration known in the art. The coil 31 is positioned between the upper shelf 14 and the lower shelf 15 so that the shaftway 33 is aligned with the apertures 17 and 18 along the axis A. When energized, the coil 31 produces a magnetic field which exerts an upward resulting force F on any ferro-magnetic object located in or directly below the shaftway 33. The spool 32 is made of a thermally conductive ceramic material. For example, the spool may be manufactured of an aluminum silicate material such as Duramic M120, manufactured by Duramic Products Inc., Palisades Park, N.J.

The sleeve 41 has a hollow tubular section 42 and a plurality of radially outwardly extending tabs 43. Tubular section 42 of the sleeve 41 is located concentrically within the apertures 17 and 18 of the respective upper and lower shelves 14 and 15 and interiorly of the shaftway 33 of the spool 32. The tabs 43 extend radially beyond the aperture 17 and rest atop the upper shelf 14, as shown, thus supporting the sleeve. The lower end 44 of the sleeve 41 engages the trip arm 21 in the reset position, as shown, for enhancing the magnetic properties of the system.

As shown in FIG. the core 51 is a mass of ferro-magnetic material having upper and lower ends 52 and 54, respectively, and a generally cylindrical shape. Overall, the core 51 has a diameter slightly less than the inner diameter of the sleeve 41. The core 51 is normally positioned concentrically within the sleeve 41 and is free to slide up and down therein. The core 51 has an upper portion 56 of a given diameter and a lower portion 58 of a diameter smaller than the upper portion 56. The size of the lower portion 58 modifies the core 51 so that it has a center of mass M concentrated in the upper portion 56 as shown. When the coil 31 is energized, the core 51 tends to be fully withdrawn into the shaftway 33 with its upper end 52 in abutment with the cover 61 and its lower end 54 spaced above the curved section 26 of the trip arm 21 by a spaced distance S.

Figure 5:
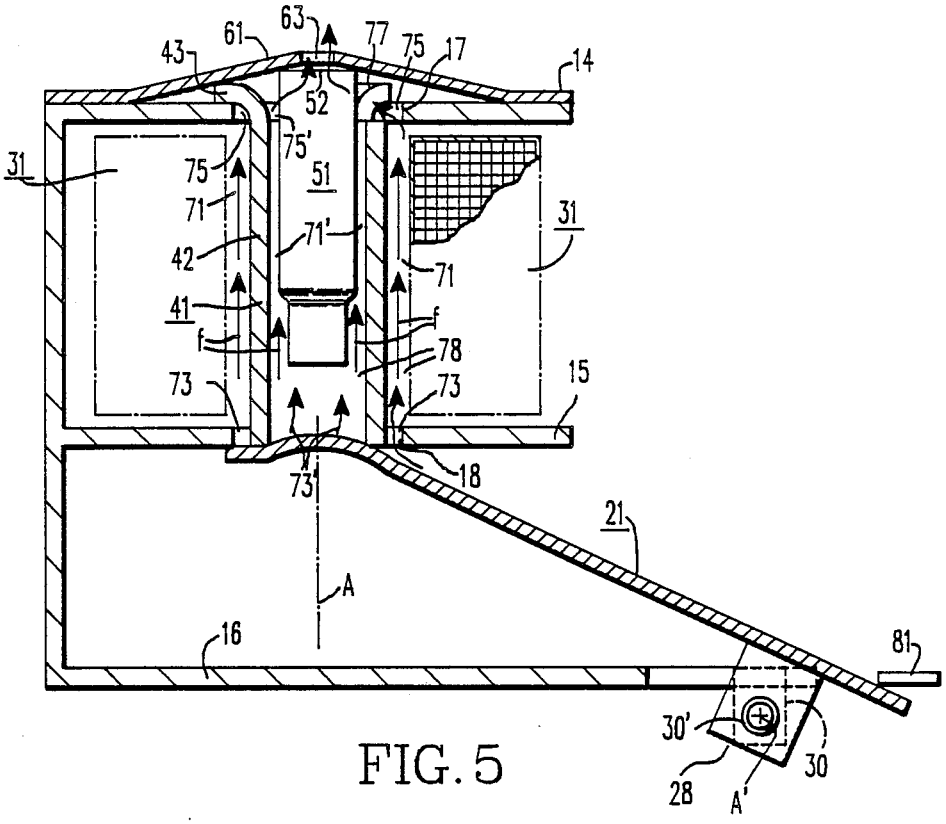
FIG. 5 is a schematic side section elevation similar to FIG. 1, illustrating the cooling air convection path.

As detailed in FIG. 5, an outer shaftway air gap 71 exists between the sleeve 41 and the coil 31. An outer air inlet gap 73 exists, as shown, between the tubular section 42 of the sleeve 41 and margin or inner diameter of the aperture 18 in the lower shelf 15. An outer air outlet gap 75 exists between the tubular section 42 of the sleeve 41 and margin or inner diameter of the aperture 17 in the upper shelf 14. Also shown in FIG. 5 is a sleeve air gap 71' between the core 51 and the tubular section 42 of the sleeve 41. An inner air inlet 73' exists below the core 51 at the lower end of the tubular section 42, and an inner air outlet 75' exists at an upper end 52 of the core 51. The outer and inner air inlet gaps 73-73', the outer and inner air outlet gaps 75-75' and the outer and inner shaftway air gaps 71-71' are part of a parallel convective flow channel 78 for ambient air. The air flow is shown by the arrows f in FIG. 5. Ambient air cools the coil 31 by convection through the parallel convection flow channel 78.

As shown in FIGS. 1–3 and 5, the apertured cover 61 for core 51 is a rectangular member having a shape similar to the upper shelf 14. The cover 61 has a central aperture 63 of a diameter less than that of the core 51 and is attached to the upper shelf at its corners by screws 65 located near the marginal edge 64 thereof. The cover 61 engages and captures the tabs 43 near the aperture 63 between itself and the upper shelf 14. The tabs 43 act to space the cover 61 away from the upper shelf 14. In securing the cover 61 to the upper shelf 14 with the tabs 43 located therebetween, the cover 61 bends slightly or becomes conically distorted over the tabs 43 leaving a small wedge air gap 77 between the tabs 43 and the cover 61 which communicates with the outer and inner outlet air gaps 75-75'. The wedge air gap 77 communicates with the central aperture 63 of the cover 61, thereby providing a continuation of the convective air path illustrated by the arrows f. The cover 61 also provides an upper stop or abutment for the upper end 52 of core 51 and thereby holds the core 51 within the assembly 10.

When the coil 31 is energized from a source of power (not shown), a magnetic field is produced which exerts the upward force F on the core. If the voltage of the source (not shown) exceeds a threshold value, the core 31 moves fully up into the sleeve 41 within the shaftway 33 until the upper end 52 engages the cover plate 61 as shown in FIG. 1. The magnetic field also exerts an upward force on the free end 24 of the trip arm 21. The force F pivots the trip arm 21 clockwise until the free end 24 engages the lower shelf 15 also as shown in FIG. 1. When an undervoltage condition occurs, the field created by the coil 31 cannot hold the core 51 suspended against the force of gravity, and the core 51 falls onto the curved section 26 of the trip arm 21. Also, the attractive force on the trip arm 21 is lower as a result of the reduced magnetic field. The force of the fall overpowers the reduced attractive force on the trip arm 21 and causes the free end 24 of the trip arm 21 to separate from engagement with the lower shelf 15 and move downwardly. Downward movement of the trip arm 21, as shown, causes the second free end 25 of the trip arm 21 to move upwardly to the tripped position shown in FIG. 2. The second free end 25 of the trip arm 21 engages the trip bar 81 of the breaker (not shown) and moves the trip bar upwardly in order to initiate a trip of the breaker. Although not shown, the breaker contains internal mechanisms which engage the trip bar 81 and oppose its upward motion, which, in turn, resists the upward motion of the second free end 25 of the trip arm 21.

In accordance with the present invention the core 51 has a given mass, which in a gravitational field can be represented by a weight located at the center of mass M. As shown in FIG. 2, the core 51 moves between a fully suspended position, shown in phantom lines, and a fully released position, shown in solid lines. The fully released position is illustrated in FIG. 2.

Between the two positions, the center of mass M of the core 51 moves a drop height h. The drop height h (FIG. 2) is equal to the tripping distance H plus the spaced distance S (FIG. 1). In accordance with the present invention, the weight of the core 51 and the drop height h provides a measure of the force which the core 51 exerts on the trip arm 21. The ratio of the lengths of each of the free ends 24 and 25, namely D/D' provides a measure of the multiplier effect or mechanical advantage provided by the undervoltage trip device 10 which is necessary to overcome the internal resistive forces associated with the circuit breaker (not shown). The weight W of the core 51 and the drop height h are sufficient to provide a force on the trip bar 81 which will guarantee operation of the circuit breaker. Movement of the first free end 24 of trip arm 21 through the tripping distance H causes a proportional displacement H' of the second free end 25 of the trip arm 21 which is sufficient to operate the circuit breaker.

The curved section 26 of the trip arm 21 further enhances the reliability of the trip device 10 of the present invention. The curvature of the curved section 26 is convex in the upward direction facing the lower end 54 of the core 51. The curved section 26 is strong, resilient and capable of withstanding repeated actuations. In addition, the upper side 26' of the curved section 26 acts as a cam surface which is engaged by the core 31 more or less at right angles throughout the drop height h (FIGS. 1 and 2). Thus wear is lower and reliability is enhanced.

Another feature of the trip device 10 is its ability to automatically reset without the need for manual intervention. After an undervoltage condition occurs, the core 51 drops and a trip occurs as aforesaid. When the undervoltage condition terminates, that is, when the voltage applied to the coil 31 is restored or reset, the force of the magnetic field produced by the coil 31 is reestablished, thereby lifting the core 31 up into the sleeve 41. The magnetic field also lifts the free end 26 of the trip arm 21 upward until it engages the lower shelf 15 as shown in FIG. 1. Thus, reset of the trip device 10 of the present invention occurs whenever sufficient power is applied to it to create a field capable of lifting the core 51 and the trip arm 21.

The coil 31 is cooled convectively as detailed in FIG. 5. The coil 31 is normally energized and maintains the core 51 suspended within the sleeve 41 as hereinbefore described. The weight W of the core 51 is such that a significant amount of power is needed to maintain the core 51 suspended within the coil 31 which creates a significant heat load on the coil 31. The present invention provides at lest two means whereby the heat load may be readily dissipated.

Heat generated by the coil 31 transfers to ambient air surrounding the coil 31 and including the gap 71 between the sleeve 41 and the coil 31. The transfer of heat is aided by the choice of material for the spool 32. Heat given up to the ambient air surrounding the exterior of the coil 31 is easily dissipated by convection currents which are not discussed in detail herein but which should be readily apparent from an observation of the drawing in FIG. 5. However, heat buildup within the shaftway 33 can cause overheating problems unless a convective air path is provided which will allow heated ambient air to escape. In accordance with the invention, the parallel convective path 78, described above, allows for the escape of heated air to thereby cool the coil 31. Although the upper end 52 of the core 51 abuts up against the cover 61, near the outer peripheral edge of the core 51, as shown in FIG. 5, the abutment of the core 51 against the cover 61 is not so tight that air flow f is inhibited. Thus, the parallel convection path 78 is continuous and efficient.

Figure 6:
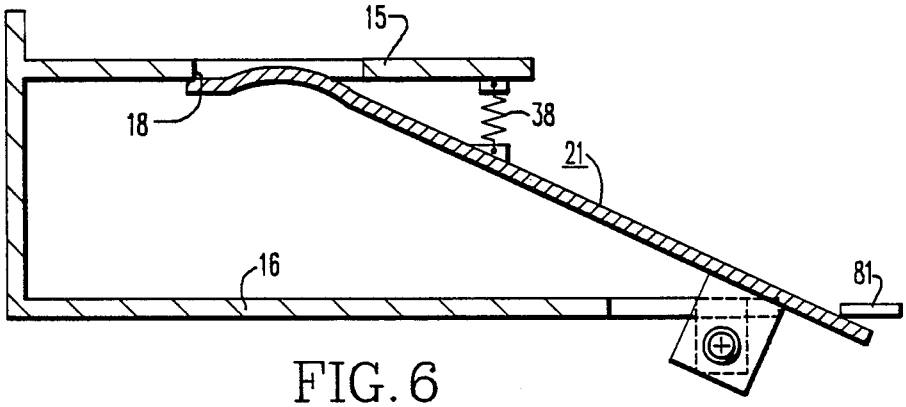
FIG. 6 is a fragmentary schematic of another embodiment of the invention showing a return spring for the trip arm.

In FIG. 6 the trip arm 21 may be non-magnetic and a return spring 38 is attached between the lower shelf 15 and the trip arm 21. Return spring 38 causes trip arm 21 to reset in the absence of an undervoltage condition.

There has, therefore, been provided an undervoltage safety device capable of producing a mechanical response sufficient to trip a circuit breaker, which mechanical response includes a force and displacement for moving a trip bar. The resulting force and displacement needs no other mechanical amplification.

While the invention has been described in connection with specific embodiments thereof, it will be understood that it is capable of further modifications. The claims are intended to cover any variations, uses or adaptations of the invention following, in general, the principles of the invention, and including such departures from the present disclosure as come within known and customary practice within the art to which the invention pertains.

What is claimed is:

1. An undervoltage trip device responsive to an undervoltage condition indicative of an unsafe condition, said undervoltage trip device producing a mechanical response of sufficient force and displacement for tripping a circuit breaker comprising a frame;

electromagnetic means carried by the frame for providing a magnetic force in the absence of said undervoltage condition;

a trip arm pivotably mounted to the frame about a fulcrum and being pivotable between a normally reset position and a tripped position, said trip arm having opposed first and second free ends, the first free end being in the reset position in the absence of said undervoltage condition, the second free end adapted to trip a circuit breaker when the trip arm is pivoted from the reset position to the tripped position;

a core releasably suspended at a first position by the electromagnetic means, said core normally disposed at a predetermined height above the first free end of the trip arm in the absence said undervoltage condition, and arranged to fall to a second position onto and engage the first free end of the trip arm when said undervoltage condition occurs, said core being sufficiently massive that its fall from the predetermined height onto the trip arm creates a force sufficient to rotate the trip arm and displace the second free end thereof from the reset position to the tripped position in order to trip a circuit breaker without additional amplification of the force or the displacement of the trip arm said core being movable from said second position to said first position by said electromagnetic means.

2. An undervoltage trip device according to claim 1, wherein said electromagnetic means for producing an electromagnetic field comprises a coil having a vertical central shaftway, said coil producing, when energized, a magnetic field capable of suspending the core in the shaftway in the absence of said undervoltage condition and for releasing the core upon the occurrence of said undervoltage condition.

3. An undervoltage trip device according to claim 2, wherein the electromagnetic means further comprises a sleeve having a tubular portion and a flanged portion, said tubular portion being sleeved within the coil shaftway and about the core, said flanged portion engaging the frame for supporting the sleeve thereon.

4. An undervoltage trip device according to claim 3, wherein the frame includes a pair of support shelf members having aligned axial apertures therein and the coil, core, shaftway and the sleeve are concentrically aligned with the apertures.

5. An undervoltage trip device according to claim 4, wherein the flanged portion of the sleeve includes a plurality of tab portions extending radially outwardly and located atop the upper shelf, said tab portions having intermediate slots therebetween.

6. An undervoltage trip device according to claim 4, wherein the sleeve, the core and the coil are in spaced relation and provide a convection air flow path for cooling the coil.

7. An undervoltage trip device according to claim 6, wherein the electromagnetic means further comprises an apertured cover secured to the frame above the sleeve and in engagement with the tab portions, said cover being secured to the upper shelf member of the frame in flow communication with the convection air flow path and providing a convective air outlet for the coil.

8. An undervoltage trip device according to claim 7, including air inlets between the aperture in the lower shelf and the sleeve and between the sleeve and the core, air outlets between the aperture in the upper shelf and the sleeve, and between the sleeve and the core, and further including the slots between the tab portions.

9. An undervoltage trip device according to claim 4, wherein said sleeve has a lower end which engages the trip arm when it is in the reset position.

10. An undervoltage trip device according to claim 9, wherein the sleeve extends into the axial aperture of the lower shelf for engaging the trip arm.

11. An undervoltage trip device according to claim 2, wherein the coil comprises a support spool of thermally conductive material, and an electrical conductor wrapped around the spool for providing windings for the coil.

12. An undervoltage trip device according to claim 2, wherein said core is an elongated member having upper and lower portions, the upper portion being larger than the lower portion, the upper portion being heavier than the lower portion for modifying the weight distribution of the core in order to create a center of mass for said core which is concentrated in said upper portion.

13. An undervoltage trip device according to claim 1, wherein the frame has a pair of spaced upper and lower parallel shelf members and a spaced lower frame member, said upper and lower shelf members having axially aligned apertures therein and the lower frame member has a fulcrum located a specified distance from the axially aligned apertures.

14. An undervoltage trip device according to claim 1, wherein the trip arm has a curved portion at the first free end and a flattened portion of the first free end remote from the pivot is adapted to engage an underside of the lower shelf member in confronting relationship.

15. An undervoltage trip device according to claim 14, wherein the trip arm includes a straight section between the pivot and the curved section interconnected at a bend line in a nearly tangent relationship with said curved portion.

16. An undervoltage trip device according to claim 15, wherein the trip arm is movable about the pivot through an angle.

17. An undervoltage trip device according to claim 15, wherein the trip arm is movable between the reset and tripped positions through a selected angle of rotation and the end of the trip arm lies at an angle with respect to the straight section at the bend line which angle is about the same as said selected angle of rotation, said free end, said curved section and said straight section being in a nonplanar relationship so that there is provided a clearance to allow the trip arm to pivot at a greater angle of rotation than would be possible if the trip arm were planar.

18. An undervoltage trip device according to claim 14, wherein the trip arm includes depending and confronting tab portions having axially aligned apertures therein, and the lower frame portion includes depending and confronting tab portions having apertures therein in alignment with the apertures in the trip arm and pivot pin means located in the apertures for pivotally connecting the trip arm to the lower frame member.

19. An undervoltage trip device according to claim 18, wherein the trip arm has one free end located a first distance from the pivot and another free end located a second distance from the pivot, the ratio of the first and second distances provides a measure of mechanical advantage of the undervoltage trip device.

20. An undervoltage trip device according to claim 3, wherein the core is displaceable a drop height between the reset and trip positions, which drop height and the mass of the core provide the available energy for tripping the circuit breaker.

21. An undervoltage trip device according to claim 1, wherein the trip arm is ferromagnetic and is attracted to the electromagnetic means in the absence of an undervoltage condition.

22. An undervoltage trip device according to claim 1, wherein a spring engages the trip arm for biasing it to the reset position.

23. An undervoltage trip device according to claim 22, wherein the coil includes a thermally conductive spool for supporting the winding.

24. An undervoltage trip device according to claim 2, further including a cover providing a stop at an upper portion of the coil and wherein the coil produces a magnetic field capable of lifting the core upwardly against the stop in the absence of the undervoltage condition.

25. An undervoltage trip device according to claim 24, wherein the cover has an aperture for providing a convective air outlet.

* * * * *